US006186503B1

(12) United States Patent
Faith

(10) Patent No.: US 6,186,503 B1
(45) Date of Patent: Feb. 13, 2001

(54) ARCADE-TYPE STAMP DISPENSING MACHINE

(76) Inventor: William B. Faith, 8807 Shirley Ave., Northridge, CA (US) 91324

( * ) Notice: Under 35 U.S.C. 154(b), the term of this patent shall be extended for 0 days.

(21) Appl. No.: 09/018,062

(22) Filed: Feb. 3, 1998

(51) Int. Cl.[7] ..... A63F 5/04

(52) U.S. Cl. ..... 273/141 R; 273/138.1; 273/402; 463/7; 463/23

(58) Field of Search ..... 463/7, 23, 36, 463/40–41; 273/141 R, 141 A, 142 R, 142 H, 142 HA, 143 R, 138.2, 460, 454, 138.1, 440, 451

(56) References Cited

U.S. PATENT DOCUMENTS 583,081 * 5/1897 Pratt ..... 273/138.2
1,554,552 * 9/1925 Bickford ..... 273/141
2,043,166 * 6/1936 Hart et al. ..... 273/138
2,224,490 * 12/1940 Simmons ..... 273/141
2,491,888 * 12/1949 Baker ..... 273/138.2
2,799,500 * 7/1957 Zekowski ..... 273/454
3,913,922 * 10/1975 Richards et al. ..... 273/143 R
4,212,465 * 7/1980 Arad ..... 273/121 A
4,411,428 * 10/1983 Nicolaus ..... 273/143 R
5,184,821 * 2/1993 Korenek ..... 273/142 B
5,318,298 * 6/1994 Kelly et al. ..... 273/122 R
5,380,008 * 1/1995 Mathis et al. ..... 273/143 R
5,511,794 * 4/1996 Katamoto ..... 273/440
5,584,170 * 12/1996 Stahlecker ..... 57/263
5,609,337 * 3/1997 Clapper, Jr. ..... 273/138.2
5,704,612 * 1/1998 Kelly et al. ..... 273/402
5,803,451 * 9/1998 Kelly et al. ..... 273/118 R
5,833,104 * 11/1998 Horniak ..... 225/106
5,907,830 * 5/1999 Engel et al. ..... 463/40
5,949,042 * 9/1999 Dietz, II et al. ..... 273/138 A
5,971,397 * 10/1999 Miguel et al. ..... 273/371
5,971,850 * 10/1999 Liverance ..... 463/23
5,978,773 * 11/1999 Hudetz et al. ..... 705/23
5,980,385 * 11/1999 Clapper, Jr. ..... 463/17
6,015,344 * 1/2000 Kelly et al. ..... 463/16

* cited by examiner

*Primary Examiner*—Joe H. Cheng
*Assistant Examiner*—John Hotaling
(74) *Attorney, Agent, or Firm*—Lyon & Lyon LLP

(57) ABSTRACT

An arcade-type stamp dispensing machine includes a clock face and an arrow assembly having an arrow rotatably supported over the clock face. An adjustable brake selectively stops rotation of the arrow assembly, while a shaft encoder detects where the arrow has been stopped over the clock face. A stamp dispenser is in communication with the shaft encoder, via a central processing unit board, for dispensing a variety of stamps. The game unit optionally includes a modem interfacing with the central processing unit board. The stamps dispensed by the stamp machine are preferably serialized and bar-coded.

15 Claims, 3 Drawing Sheets

ARCADE-TYPE STAMP DISPENSING MACHINE

BACKGROUND OF THE INVENTION

The field of the present invention generally relates to arcade-type machines.

Numerous arcade games exist to entertain the player. Most of these games involve a combination of skill and chance. Few of these games involve only skill. For example, an arcade may contain a basketball free throw shooting machine or punching machine. Of the minority of arcade games involving skill that can be found in today's arcades, only a small percentage of these reward a player with a particular prize. The epitome of such prize dispensing machines is the stalwart crane and claw device. This machine has a supply of potential prizes over which the player maneuvers a claw, releasing the claw in an attempt to grasp the prize. If the claw successfully grasps a prize, the claw retracts with the prize and deposits the prize in a prize dispensing slot.

Arcade game players enjoy prize dispensing machines because they are rewarded for their skill. However, the reason why arcades are not replete with these machines is because the owners of arcades understand all too well such machines' deficiencies. Take for example the above-identified crane and claw device. Arcade game owners know that they will have to stock and maintain a constant supply of prizes in the game itself. Not only does this require routine upkeep, but it presents another disadvantage in that the arcade game itself must be substantially large to hold all the prizes. In the alternative, the arcade game owner may dispense tokens or tickets to the player who can exchange them at a redemption center located in the arcade itself. This requires an operator during business hours to display the prizes and merchandise and distribute them on site. Such a system increases overhead while decreasing space which could be used for more arcade games.

Furthermore, arcade game owners usually cannot manipulate the typical prize dispensing machine to increase or decrease the skill level involved. Similar to the basketball free throw shooting machine, the skill level of the crane and claw device remains fixed. An arcade game player who can exert control over a game and master it will not be challenged and will not be a repeat customer. Therefore, a variable skill level arcade game that rewards the player for his increasing expertise, with a particular prize which need not be kept on location within the arcade itself, is desired.

SUMMARY OF THE INVENTION

The present invention is directed to an arcade-type game stamp dispensing machine that includes a clock face and an arrow assembly having an arrow rotatably supported over the clock face. An adjustable brake selectively stops rotation of the arrow assembly about the clock face, while a shaft encoder detects where the arrow has been stopped. The shaft encoder interfaces with a central processing unit board having a plurality of DIP switches. A stamp dispenser is in communication with the shaft encoder, via the central processing unit board, for dispensing different types of stamps.

The stamps are preferably serialized and bar-coded. In order to obtain a prize, the player mails the stamps to a prize distribution center located at a site different from the site of the arcade. To these ends, prizes can be distributed across state lines. In lieu of the fixed prize distribution center, prizes can also be dispensed by a prize dispensing truck. Advantageously, the owner of the stamp machine can adjust the skill level of the game in numerous ways.

Accordingly, it is an object of the present invention to provide an improved game unit and method of rewarding a player for increasing hand-eye coordination with a particular prize which need not be kept on location within the arcade. Other and further objects and advantages of the present invention will be further understood and appreciated by those skilled in the art by reference to the following specification, claims, and annexed drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
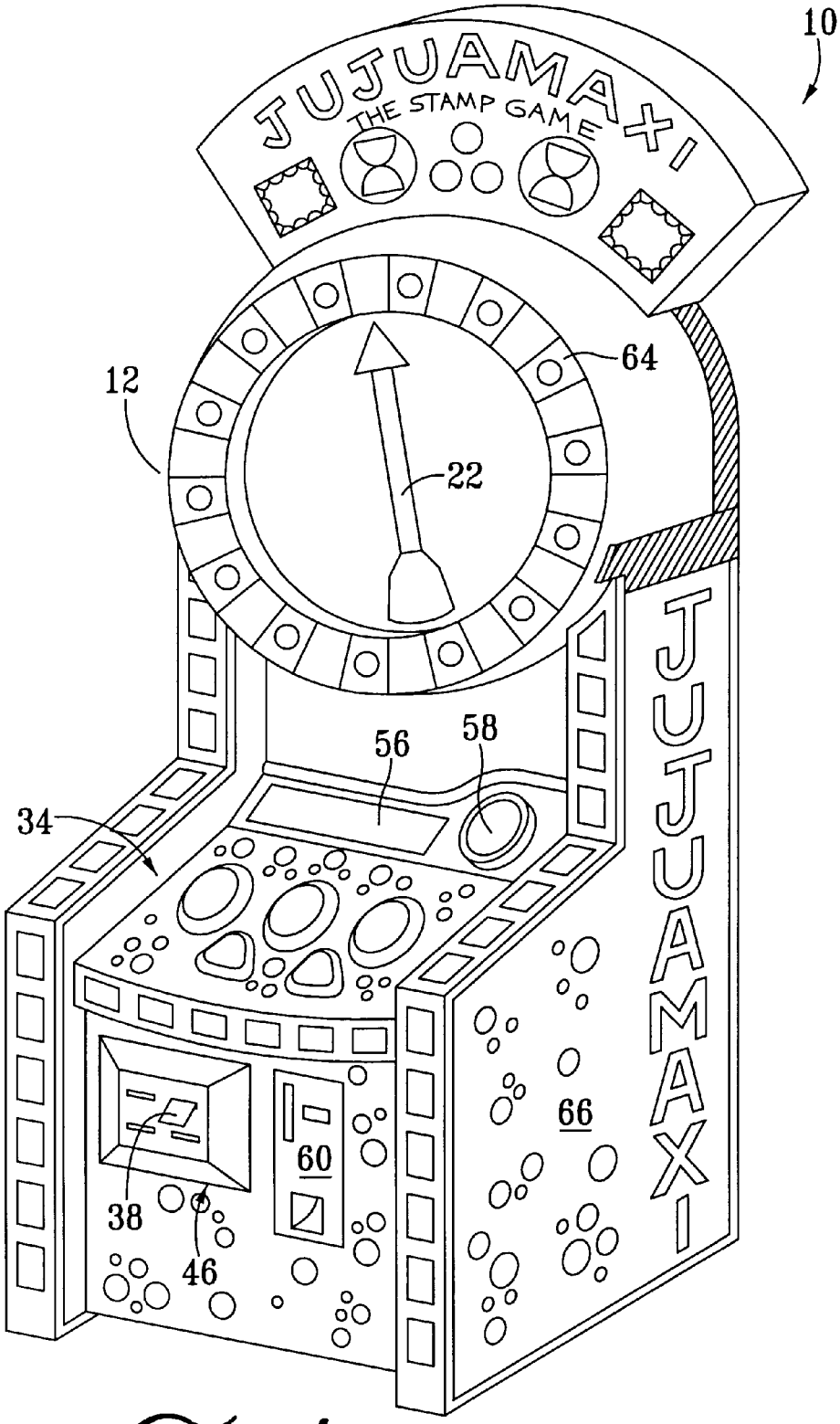
FIG. 1 is a perspective view of a game unit according to a preferred embodiment of the present invention.

Turning in detail to the drawings, as shown in FIG. 1, the game unit 10 includes a clock face 12 and an arrow 22 rotatably supported over the clock face 12. The clock face 12 has a plurality of pre-determined target input areas 64 and is preferably lighted. Directly beneath the clock face 12, the game unit 10 has a display board 56 showing the last coin score/rpm, credits, and total score. Preferably, a dot matrix display to guide the novice player exists in lieu of the display board 56.

Proximate the display board 56, a player console 34 can be seen having numerous control buttons 36 for interacting with the internal components of the game unit 10. The control buttons 36 are adapted to flash intermittently when operable. The particular control buttons 36 are: Start, Stop, Super Fast Skill Stop Mode, Double Down, and Take Stamps. Discussed in more detail below, the Stop and Super Fast Skill Stop Mode control buttons 36 can be adapted to selectively stop rotation of the arrow 22 about the clock face 12.

A stamp dispenser 46 and a coin acceptor 60 are mounted to the body 66 of the game unit 10 beneath the player console 34. The stamp dispenser 46 stores and selectively dispenses a stamp 38 corresponding to the value of points earned by a player in skillfully stopping the arrow 22 over one of the plurality of pre-determined target input areas 64. The game unit 10 might contain one to four stamp dispensers 46 and one to two coin acceptors 60. With four stamp dispensers 46, a greater variety of stamps 38 can be dispensed therefrom. While the game unit 10 should not be limited to four stamp dispensers 46, the game unit 10 preferably has two to three stamp dispensers 46.

The stamps 38 vary with respect to size, color, value, and shape. Furthermore, the stamp backing may be gummed or self-adhesive. The stamp dispenser 46 preferably stores and dispenses two types of stamps 38 with a lower and higher value, respectively. Regardless of the type of stamp 38, all are serialized and bar coded for inventory and tracking purposes. The stamps 38 should be die cut to correspond to an outline in a stamp book (not shown). This is because the stamps 38 are to be affixed to a stamp book by the player in order to receive a prize. The player should be able to find stamp books in a pocket attached to the body 66 of the game unit 10; however, an operator of the arcade may be able to provide stamp books. The same should be true of the catalog of prizes that the player can trade the stamps 38 in for.

The stamp books have different themes. For example, one theme involves traveling coast to coast where the object is to collect different scenic highlights or famous national monuments or people. The shapes of the stamp books preferably correspond to the particular theme. The stamp book might be in a book format or a map format that folds out. In order to have a particular prize delivered to the player's address, the player completes the consumer information section located on the back cover of each stamp book. A full stamp book can be worth more in value than the actual value of the stamps 38 therein. After the player has the proper amount of filled stamp books for the desired prize(s), the player then mails the stamp books to the prize distribution center. The prize distribution center is at a site different from that of the arcade itself. To these ends, prizes can be distributed across state lines. After two to five days to process the stamp books, the game player receives the respective prize(s) through the mail. In lieu of the fixed prize distribution center, prizes can also be dispensed by a prize dispensing truck. The prize dispensing truck would routinely visit the arcade where the present game units are located.

Advantageously, the present game unit 10 enables arcade game owners to decrease overhead while increasing space which could be used for more games within the arcade. This is because an owner of the present game unit 10 will not have to constantly stock and maintain a steady supply of prizes therein. As such, the present game unit 10 is substantially smaller than the traditional prize dispensing machine. Furthermore, an owner of the present game unit 10 does not have to hire an operator during business hours to display and distribute prizes at a redemption center located in the arcade itself.

Figure 2:
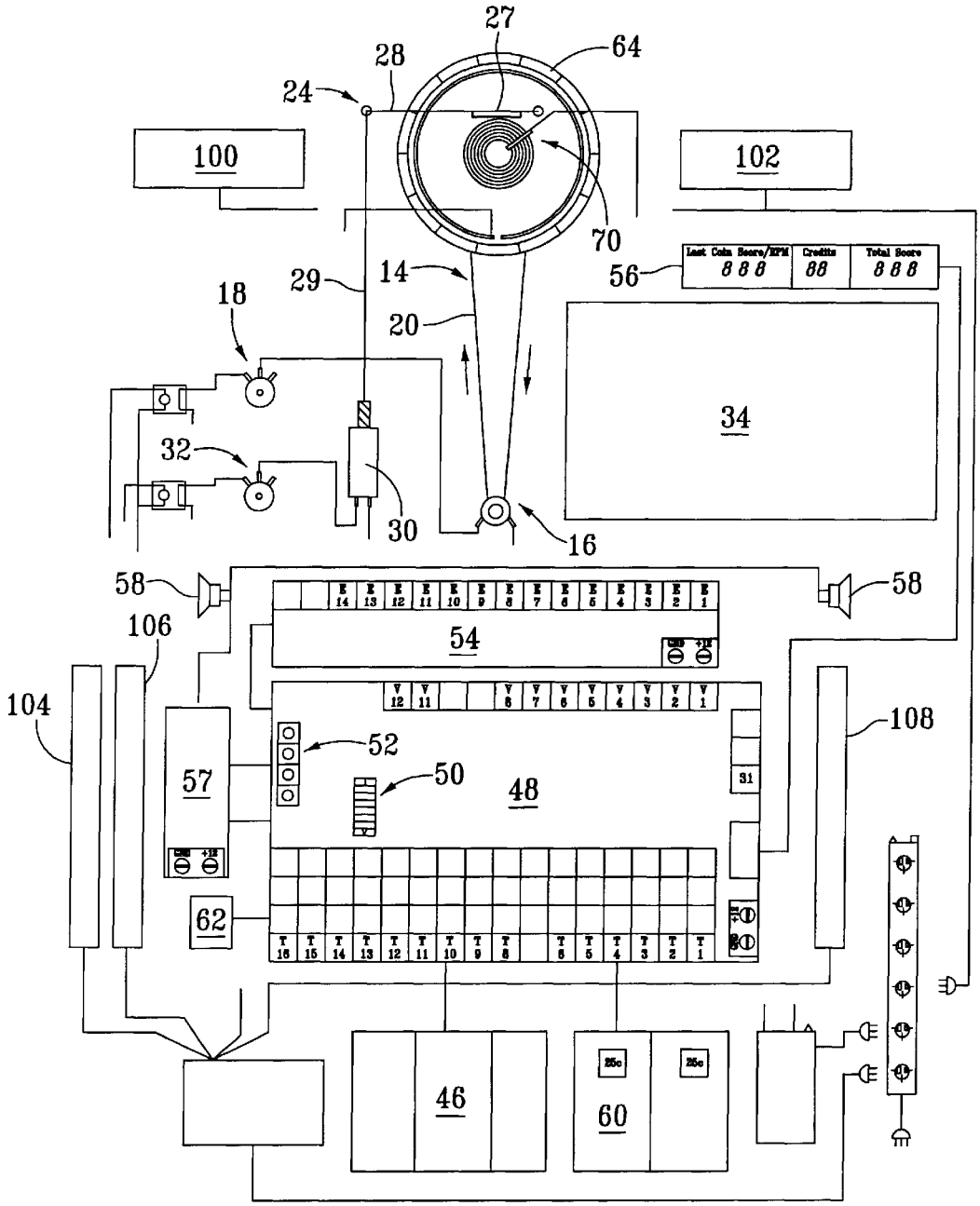
FIG. 2 is a wiring diagram of the game unit shown in FIG. 1.

Referring to FIG. 2, a wiring diagram illustrates the internal components of the game unit 10. The major component is the central processing unit board 48 having a plurality of DIP switches 50 and a four-button keypad 52. Mounted on a sheet metal panel attached to the floor of the body 66 (seen in FIG. 1), the central processing unit board 48 controls game operation. The central processing unit board 48 interfaces with the above-mentioned stamp dispenser 46, coin acceptors 60, player console 34, and the display board 56. The central processing unit board also interfaces with the following components to be discussed in more detail below: an audio board 57, a vend expansion board 54, an adjustable brake assembly 24, an arrow assembly 14, a shaft encoder 70, and optionally, a modem 62.

The audio board 57 is mounted on the sheet metal panel proximate the central processing unit board 48. Connected to a left speaker 58 and a right speaker 58, the function of the audio board 57 is to generate sound effects to entertain the player. Mounted on the sheet metal proximate the audio board 57 and central processing unit board 48, the vend expansion board 54 provides outputs in addition to those supplied by the central processing unit board 48 required to operate the game.

Figure 3:
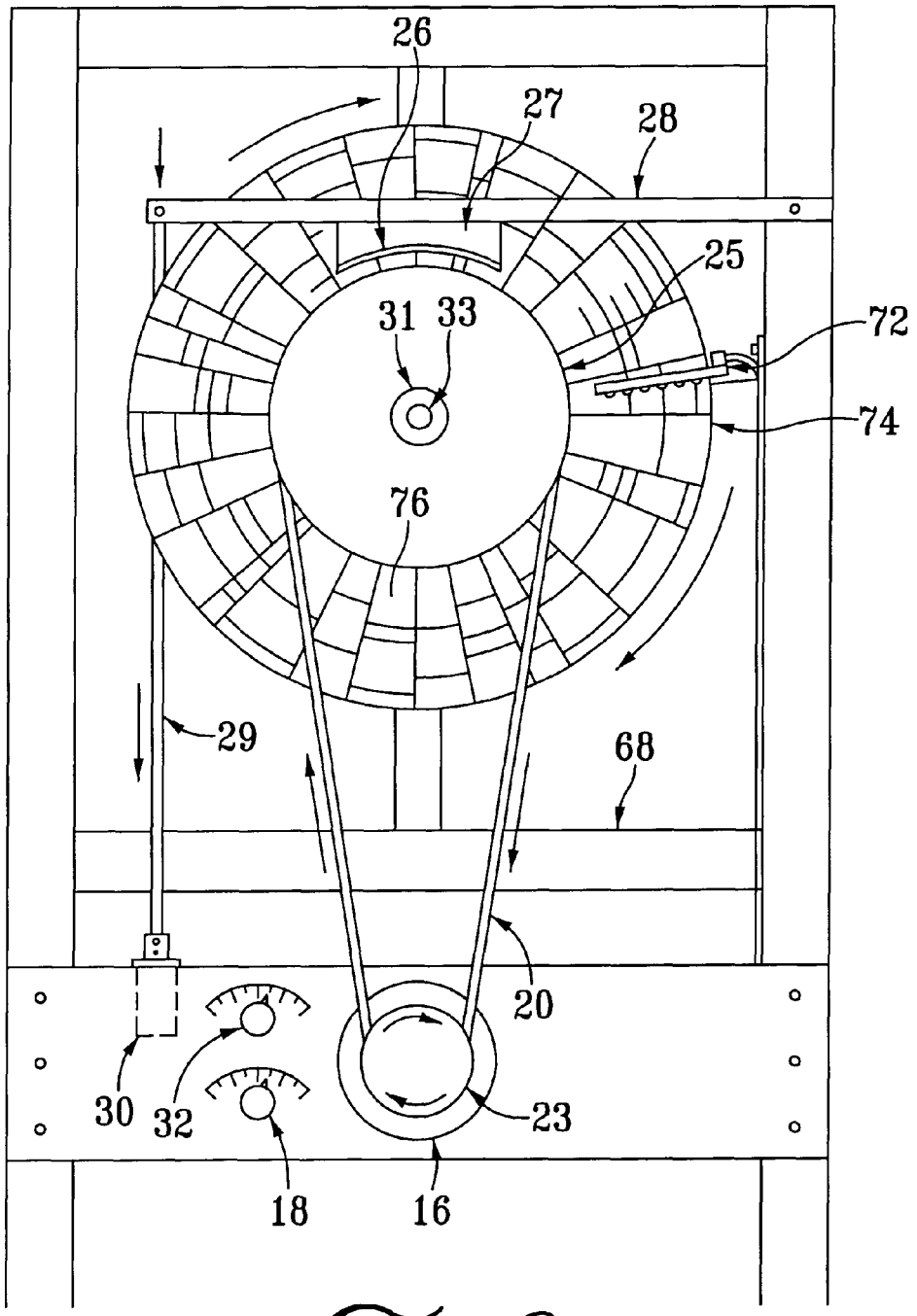
FIG. 3 is a front section view of the motor, brake, and shaft encoder of the game unit shown in FIG. 1.

As seen in FIG. 3, the brake assembly 24 includes a brake shoe 27 having a brake pad 26, a brake arm 28 connected to the brake shoe 27, a solenoid 30 in communication with the brake arm 28, and a rheostat 32 interfacing with the solenoid 30. The brake arm 28 is mounted substantially horizontally to a frame 68 of the body 66 whereby the brake pad 26 is in close proximity to the arrow assembly 14. Mounted substantially perpendicular to the brake arm 28 is a brake linkage 29. Energized by the solenoid 30, the brake linkage 29 pulls in a downward direction such that the brake pad 26 contacts the arrow assembly 14.

The strength by which the solenoid 30 pulls downward can be adjusted by manipulating a rheostat 32. Turning the rheostat 32 in a clockwise direction will decrease the brake strength, while counter-clockwise rotation increases brake strength. The brake assembly 24 can also be adjusted by setting one of the plurality of DIP switches 50. For example, DIP switch number 4 can be set to control the amount of time that must elapse once the arrow 22 has rotated a pre-determined minimum number of revolutions per minute before the game will respond to the player pushing the Stop and/or Super Fast Skill Stop control buttons 36.

The brake assembly 24 can also be adapted to contact the arrow assembly 14 intermittently until the arrow 22 reaches a pre-determined number of revolutions per minute. The factory setting of the Super Fast Skill Stop control button 36 is such that the once this control button 36 is pushed, the brake 24 engages for several seconds. However, the owner of the present game unit 10 can set DIP switch number 5 to engage the brake 24 only when the Super Fast Stop Skill Stop control button 36 is pushed. Once the player has intermittently bounced the brake 24 off of the arrow assembly 14 and the rotation of the arrow 22 has begun to slow, stopping the arrow 22 over a desired target input area 64 becomes easier for the player. To increase the skill level, the owner of the present game unit 10 can program the Super Fast Skill Stop control button 36 to be inoperable when the arrow 22 has reached a pre-determined minimum number of revolutions per minute.

Advantageously, the adjustability of the brake assembly 24 enables the owner of the present game unit 10 to manipulate the skill level of the game to maintain a player's interest.

Turning in detail again to FIG. 3, the arrow assembly 14 can be seen having a belt 20 connecting a first pulley 23 and an opposing second pulley 25, a motor 16 proximate the first pulley 23 for energizing the belt 20, and a=rheostat 18 interfacing with the motor 16 for adjustably rotating the arrow 22 about the clock face 12. Similar to the adjustability of the brake strength, turning the rheostat 18 in a clockwise direction will decrease the arrow speed or number of revolutions per minute, while counter-clockwise rotation increases the arrow speed or number of revolutions per minute. The second pulley 25 has a bearing assembly 31 with a post 33 centrally located therein. It is this second pulley 25 which the brake pad 26 actually contacts to slow or stop rotation of the arrow 22. The post 33 of the second pulley 25 supports the arrow 22 (seen in FIG. 1) for spinning about the clock face 12. It is preferable that the arrow 22 rotates about the clock face 12; however, in another embodiment, the clock face 12 rotates under a fixed arrow 22.

Advantageously, the adjustability of the arrow speed enables the owner of the present game unit 10 to manipulate the skill level of the game to maintain a player's interest.

The shaft encoder 70 is a means for detecting where the arrow 22 is positioned over the clock face 12. As seen in FIG. 3, the shaft encoder 70 has a sensor board 72 positioned over a flywheel 74 with sensor slots 76. The clock face 12 (seen in FIG. 1) is in turn positioned over the flywheel 74. The shaft encoder 70, via the sensor board 72, interfaces with the central processing unit board 48 to dispense the appropriate stamp 38 won by the player. Each sensor slot 76 has a factory setting value corresponding to the target input area 64 of the clock face 12 the arrow 22 is presently positioned thereover. The owner of the present game unit 10 can manipulate the factory setting of each sensor slot 76 to further enhance the player's motivation to earn prizes.

Returning to FIG. 2, the game unit 10 preferably has a modem 62 interfacing with the central processing unit board 48 to transfer data relative to the game's use. Data might be collected on the number of times coins/currency/tokens were received as well as the number and type of stamps 38 that were dispensed. Such data can be collected through an infrared beam or a r.s.232 jack and stored in the central processing unit board 48. If the game unit 10 does not have a modem 62 or other means of transmitting data, this information can be accessed by service personnel with a hand held device.

It should be noted that the present game unit 10 need not be limited to any particular theme. For example, the arrow 22 may be interchanged with a spinning sword. Furthermore, the clock face 12 and arrow 22 may be interchanged with a coin gun where the player can earn points based on skill, collect the corresponding stamps 38, and mail off the requisite number of stamp books for the desired prize. Similarly, the method of dispensing stamps for rewarding a player need not be limited to any particular game unit. Finally, ajackpot feature can be added to the present game unit 10. The jackpot feature has an hourglass with an arrow that begins to adjustably rotate when the player lands on a certain target input area 64 of the clock face 12. The jackpot arrow stops only after the player lands on another target input area 64 of the clock face 12. Wherever the jackpot arrow is pointing to is the amount of points or stamps 36 that will additionally be won. The jackpot feature may include an additional hourglass for another level of challenge to the player.

In operation, basic game play starts with the player inserting money. The player then pushes the flashing Start control button 36 on the player console 34. At this time, if the player can push the Stop control button 36, the arrow 22 will coast to a stop. However, if the player can press the Super Fast Skill Stop control button 36, the arrow 22 will either stop suddenly (in the factory default setting) or stop intermittently (in the intermittent contact setting). If the player skillfully lands on a target input area 64 of any value, the Double Down and Take Stamps control buttons 36 will flash back and forth. The player then has the choice to either take the stamps 36 won or risk the amount of stamps 36 won. If the player pushes the Take Stamps control button 36, the stamp(s) 36 won will be dispensed. However, if the player selects the Double Down control button 36, the Start control button 36 flashes and the process repeats. If the player skillfully stops the arrow 22 over a target input area 64 having a positive value, the player wins double the amount of stamps 36 risked. Otherwise, the player forfeits the amount of stamps 36 risked. At this point, the process repeats.

To these ends, a player has the choice to continue playing in an attempt to earn enough stamps 36 for a particular prize seen in the catalog. In order to enhance the entertainment value to the player, the owner of the present game unit 10 can program audio effects (via the left and right audio speakers 58) and visual effects (via a left fluorescent lamp 100, right fluorescent lamp 102, left trim neon light 104, front trim neon light 106, and right trim neon light 108).

Thus, a variable skill level game unit and method of rewarding a player for increasing hand-eye coordination with a particular prize collected from a prize distribution center located at a site different from that of the arcade itself has been disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. An arcade-type game stamp dispensing machine including a variable skill level game that rewards a player for increasing hand-eye coordination comprising:

a clock face having a shaft encoder;

an adjustable arrow assembly including an arrow rotatably supported over the clock face, the arrow being adjustably rotatable for varying the skill level of the game;

an adjustable player-actuated brake assembly for selectively stopping rotation of the arrow about the clock face, the brake being adjustable for varying the skill level of the game; and a stamp dispenser interfacing with the shaft encoder for dispensing a stamp based upon a player's hand-eye coordination.

2. The arcade-type game stamp dispensing machine of claim 1 wherein the adjustable brake assembly has a brake shoe, a brake arm connected to the brake shoe, a solenoid in communication with the brake arm, and a rheostat interfacing with the solenoid.

3. The arcade-type game stamp dispensing machine of claim 1 further comprising a belt, a motor energizing the belt, and a rheostat interfacing with the motor for adjustably rotating the arrow about the clock face.

4. The arcade-type game stamp dispensing machine of claim 1 further comprising a central processing unit board and a player console interfaced with the central processing unit board, the central processing unit board having a plurality of DIP switches.

5. The arcade-type game stamp dispensing machine of claim 4 wherein the adjustable brake assembly is linked to a rheostat, the brake assembly being adjustable by manipulating the rheostat and at least one of the plurality of DIP switches on the central processing unit board.

6. The arcade-type game stamp dispensing machine of claim 4 wherein the player console has a means for selectively engaging the adjustable brake assembly after the arrow has reached a pre-determined number of revolutions per minute.

7. The arcade-type game stamp dispensing machine of claim 1 further comprising a central processing unit board and a modem for transferring data collected by the central processing unit board to an operator.

8. The arcade-type game stamp dispensing machine of claim 1 further comprising a coin acceptor, a display board, and an audio speaker.

9. The arcade-type game stamp dispensing machine of claim 1 wherein the stamp dispensed by the stamp dispenser is serialized and bar coded.

10. A variable skill game comprising:

a target face having a plurality of predetermined target input areas;

an adjustable motorized arrow assembly having an arrow adapted to adjustably spin about the target face, wherein the spin is adjustable for varying the skill level of the skill game;

an adjustable player-actuated brake assembly for selectively stopping the arrow over one of the plurality of pre-determined target input areas, the brake assembly having a brake shoe, a brake arm connected to the brake shoe, a solenoid in communication with the brake arm, and a rheostat interfacing with the solenoid, wherein the brake assembly is adjustable for varying the skill level of the skill game;

a means for detecting where the arrow is positioned over the target face after being stopped by a player; and a stamp dispenser interfacing with the means for detecting, wherein the stamp dispenser selectively dispenses a stamp corresponding to points earned by the player in skillfully stopping the arrow over one of the plurality of pre-determined target input areas.

11. The skill game of claim 10 wherein the brake assembly can be adapted to contact the arrow assembly intermittently until the arrow reaches a pre-determined number of revolutions per minute.

12. The skill game of claim 10 further comprising a player console interfacing with the brake assembly for selectively engaging the brake assembly.

13. A game unit including a variable skill game that rewards a player for increasing hand-eye coordination comprising:

a central processing unit board programmed for a game of agility;

a stamp dispenser interfacing with the central processing unit board;

a shaft encoder interfacing with the central processing unit board;

an adjustable arrow assembly including an arrow rotatably supported over the shall encoder;

an adjustable player-actuated means for prohibiting rotation of the arrow; and a player console for selectively engaging the means for prohibiting rotation of the arrow.

14. The game unit of claim 13 further comprising a modem linked to the central processing unit board.

15. The game unit of claim 13 wherein the stamp dispenser dispenses a serialized and bar-coded stamp.

* * * * *